US005220765A

United States Patent [19]

Kubik et al.

[11] Patent Number: 5,220,765

[45] Date of Patent: Jun. 22, 1993

[54] SPACE FRAME STRUCTURE

[76] Inventors: Leszek A. Kubik, 20 Long Meadow, Farnsfield, Nottingham NG22 8DR; Marian L. Kubik, deceased, late of Ravenshead; by Norma Kubik, administrator, Nadolnik 17 Birchwood Drive, Ravenshead Nottingham NG15 9EE, all of United Kingdom

[21] Appl. No.: 803,343

[22] Filed: Dec. 4, 1991

[30] Foreign Application Priority Data

Dec. 8, 1990 [GB] United Kingdom ..... 9026730

[51] Int. Cl.[5] ..... E04B 5/19

[52] U.S. Cl. ..... 52/648.1; 52/338; 52/349; 52/650.1

[58] Field of Search ..... 52/581, 648, 348, 349, 52/650.01, 338

[56] References Cited

U.S. PATENT DOCUMENTS

| | | | |
|---|---|---|---|
| 729,799 | 6/1903 | Schratwieser | 52/338 |
| 975,426 | 11/1910 | Hill | 52/349 |
| 1,911,018 | 5/1933 | Goeltz | 52/650.1 X |
| 2,058,386 | 10/1936 | Parsons | 52/349 |
| 2,087,867 | 7/1937 | Balduf . | |
| 3,110,049 | 11/1963 | Nagin | 52/338 X |
| 3,289,371 | 12/1966 | Pearson et al. | 52/338 |
| 3,320,704 | 5/1967 | Forsythe et al. | 52/338 X |
| 3,596,421 | 8/1971 | Miller | 52/338 |
| 4,115,971 | 9/1978 | Varga . | |
| 4,151,694 | 5/1979 | Seiberg et al. | 52/338 |
| 4,660,339 | 4/1987 | Paz | 52/348 |

FOREIGN PATENT DOCUMENTS

| | | | |
|---|---|---|---|
| 0169015 | 7/1985 | European Pat. Off. . | |
| 0418520 | 10/1934 | United Kingdom | 52/338 |
| 2228503 | 1/1990 | United Kingdom . | |

*Primary Examiner*—Carl D. Friedman
*Assistant Examiner*—Wynn Wood
*Attorney, Agent, or Firm*—Davis, Bujold & Streck

[57] ABSTRACT

A space frame structure comprises an upper rectangular grid of structural members, a lower grid of structural members and interconnecting members joining the grids together to form a space frame. A concrete layer is poured on to shuttering carried by lower flanges of the upper grid members with these upper members partially embedded in the concrete to form a composite upper layer. At least two upper members of each grid rectangle have upper flanges embedded in the concrete, and at least one of the members from the same grid rectangle is without an upper flange to facilitate installation of the shuttering.

8 Claims, 3 Drawing Sheets

SPACE FRAME STRUCTURE

BACKGROUND TO THE INVENTION

The invention relates to space frame structures. The invention is concerned in particular with a space frame structure of the kind described in our published United Kingdom Patent Application GB-A-2228503 (corresponding U.S. Pat. No. 5,079,890). The known space frame structure comprises an upper grid of structural members, a lower grid of structural members, interconnecting members extending between the upper grid and the lower grid and joining the grids together to form a space frame, and a concrete layer carried by the upper grid, wherein the structural members of the upper grid are at least partially embedded in the concrete to unite them structurally with the concrete and thus form a composite upper layer. The upper structural members normally have lower flanges intended to support shuttering on which the concrete layer is to be poured. Typically the structural members are I-section members so that they also have upper flanges to facilitate keying to the concrete.

The provision of both upper and lower flanges creates a problem because it then becomes difficult or impossible to insert closely fitting shuttering between the upper and lower flanges after the structure has been built. Typical shuttering is corrugated steel sheet and it is particularly desirable to have a close fit at the ends of the corrugations to prevent undue escape of poured concrete.

A further difficulty with shuttering which only partially overlaps the lower flanges is that before it becomes fixed there is a risk of it dropping through the space between the corresponding lower flanges. GB-A-2228503 also acknowledges that the upper members may be of inverted T-section and this facilitates installation of closely fitting shuttering. However the absence of an upper flange on an inverted T-section has the disadvantage of diminishing the keying between the partly embedded member and the concrete. A known compromise is to provide an irregular section with a smaller upper flange than lower flange but sections of this nature find very little use in industry and thus are not readily available. Production of such non-standard sections is expensive. Even the smaller upper flange can cause difficulties in installing a closely fitting sheet of shuttering.

An object of the invention is to overcome or to reduce the above mentioned disadvantages.

SUMMARY OF THE INVENTION

The invention is concerned with a space frame structure comprising an upper rectangular grid of structural members, a lower grid of structural members, interconnecting members extending between the upper grid and the lower grid and joining the grids together to form a space frame, and a concrete layer carried by the upper grid, the structural members of the upper grid being at least partially embedded in the concrete to unite them structurally with the concrete and thus form a composite upper structural layer, each member of the upper grid having a lower flange supporting shuttering for the concrete. The structure is characterised in that at least two of the members forming each upper grid rectangle have upper flanges extending into the grid rectangle and at least one of the members from the same grid rectangle is without an upper flange extending into that grid rectangle. The absence of at least one upper flange extending into the grid rectangle facilitates the installation of shuttering while the presence of some flanges helps to unite the upper grid as a whole with the concrete.

Preferably for at least the majority of upper grid rectangles, two mutually opposed members have upper flanges extending into the rectangle and the other two mutually opposed members are without upper flanges extending into the grid rectangle. This arrangement is particularly attractive with corrugated steel shuttering with corrugations extending longitudinally between the members without flanges and with lateral flexibility of the sheet allowing it to be deformed for insertion under the side flanges.

Preferably the upper grid is constituted primarily by I-section members extending in one direction and inverted T-section members extending in a direction perpendicular thereto. With some kinds of shuttering, it is in order to employ I-sections in one direction and alternate T-sections and I-sections in the opposite direction so that each grid rectangle has flanges extending into it along three sides. Shuttering in two or more sections can be inserted readily with only one missing flange. In many cases it may be possible to insert a single corrugated shuttering sheet with only one flange missing because the corrugations can permit sufficient reduction in width for insertion in the end opposite the end without a flange and the shuttering can then be tilted down into position.

A still further alternative is to make use of inverted J-sections but this is not recommended in general because such asymmetric sections are not readily available and the absence of symmetry can tend to lead to twisting under load.

The upper and lower grids and interconnecting members may be formed from pre-fabricated modules each comprising an upright interconnecting member, upper horizontal structural members extending from the top thereof and lower horizontal structural members extending from the bottom thereof. The invention also extends to such a module comprising four upper horizontal structural members at right angles to one another in which at least two of the upper members are of I-section and at least one of the upper members is of inverted T-section.

BRIEF DESCRIPTION OF THE DRAWINGS

Embodiments of the invention will now be described by way of example only with reference to the accompanying drawings in which.

DESCRIPTION OF PREFERRED EMBODIMENTS

Figure 1:
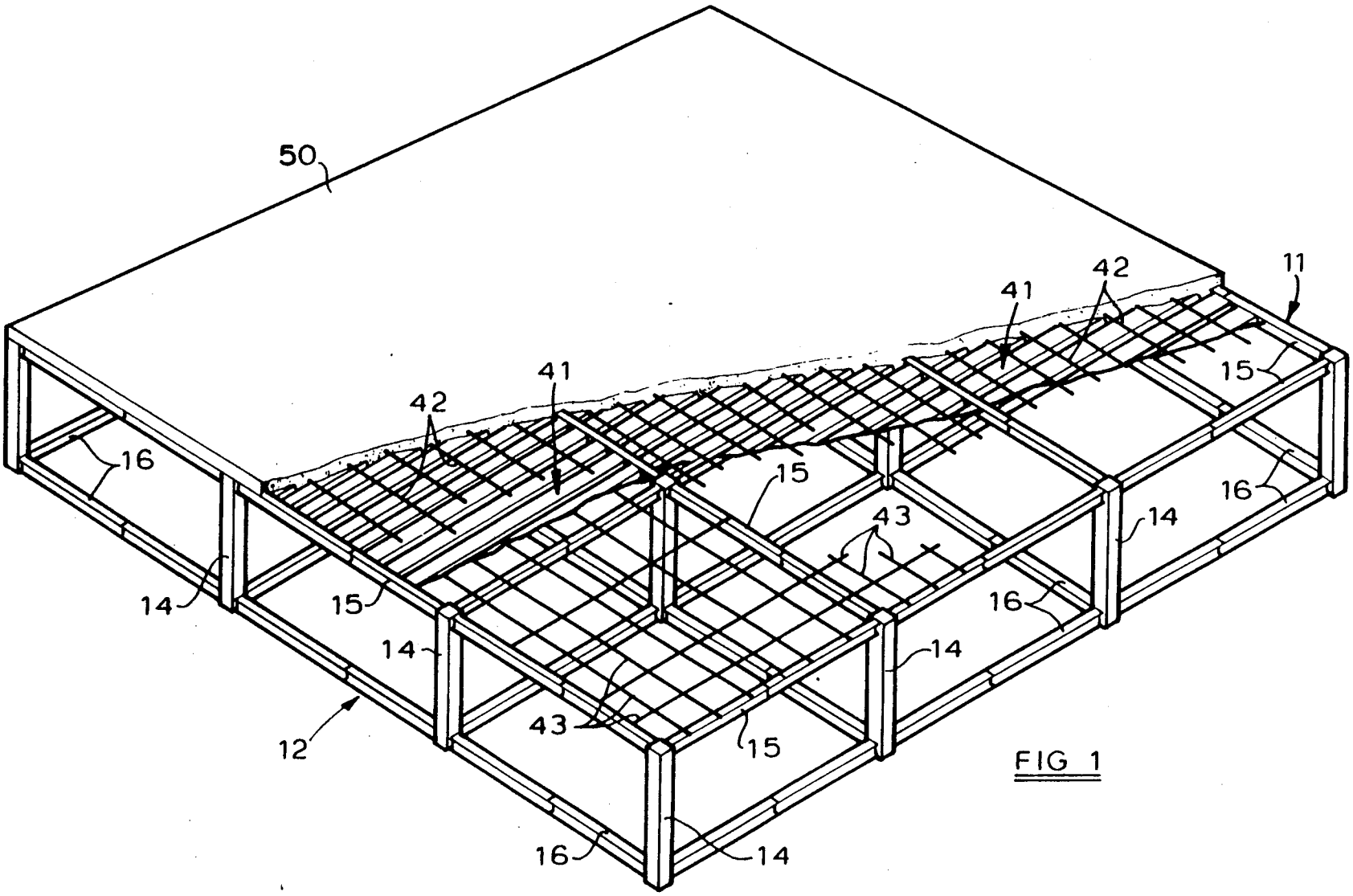
FIG. 1 is a perspective view of a composite space frame structure of the kind to which the invention may be applied and with some parts removed for clarity of illustration.
Figure 2:
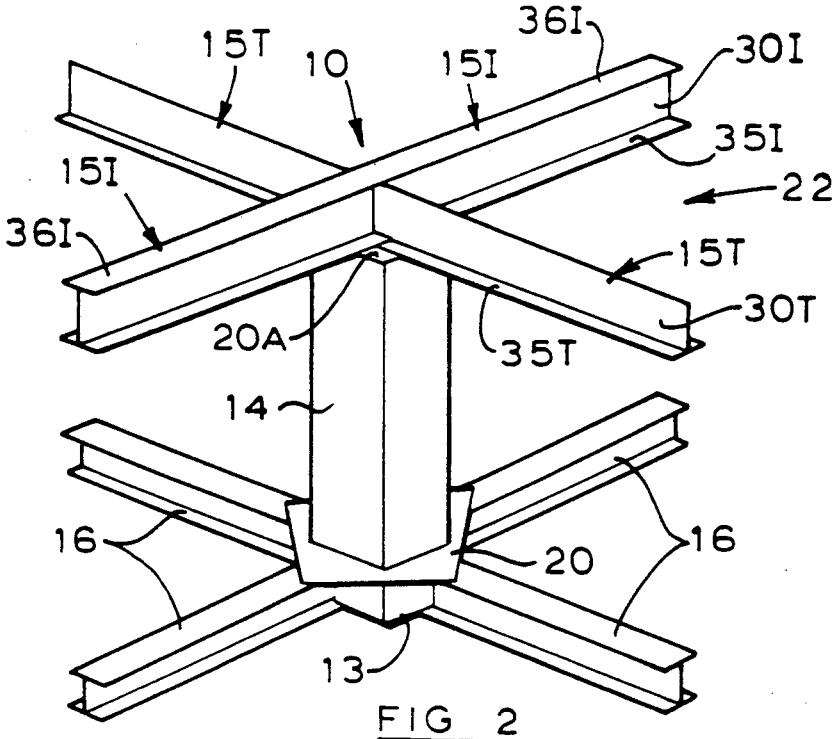
FIG. 2 is a perspective view of a typical module for building along with other modules into a structure in accordance with the invention.

The composite space frame structure of FIG. 1 incorporates a steel space frame assembled from modules as illustrated in FIG. 2. As best seen in FIG. 2, a typical module 22 comprises an upright hollow square section structural member 14 with four upper members referenced 15I and 15T (15 in FIG. 1) extending horizontally at right angles to one another from an upper joint 10 and four further lower structural members 16 extending in corresponding directions from a lower joint 13. Upper members 15I are of I-section and upper members 15T are of inverted T-section. FIG. 1 is a diagrammatic representation of a complete structure and does not show details such as the cross sectional shape of the individual members. Each lower horizontal structural member is an I-section beam. In general the lower members 16 are of greater cross-sectional area and thus strength than the upper members. The members of the module are welded together to form the module. Each lower joint is reinforced by a reinforcing plate 20 which has a square central aperture through which the upright 14 passes. Plate 20 is welded to the upright 14 and to each of the four horizontal members. Plate 20 could be omitted or replaced by a plate of a different shape or individual plate for each horizontal member.

The upright 14 terminates in an end plate 20A. The two members 15I are constituted by a single I-section beam welded to plate 20A and to the upright 14. Members 15T are constituted by two separate T-section members having a short section of flange cut away so that their flanges can be welded to plate 20A, upright 14 and the lower flange of member 15I while their webs extend across a lower flange of the I-section and are welded to the web of the I-section. Depending on the relative depths of the webs of the I and T sections, the upper part of the T-section web may also be cut away to clear the upper flange of the I-section.

Each module is assembled by welding in a jig in a factory and is subsequently transported to the site where it is to be joined with other modules in building up a complete structure.

Adjacent modules are joined together with the free ends of their horizontal structural members placed end to end. These members have their webs joined by plates and bolts as illustrated more clearly in GB-A-2228503 and also illustrated in FIG. 3. Webs 30T of members 15T are joined by plates 31 and bolts 34 while webs 33 of members 16 are joined by plates 32 and bolts 37. In practice the plates are each welded to one side of one of the structural members of a joint during assembly of the module. This distributes the load applied through the bolts to the web and thus strengthens the joint. The welding of the plates to the structural members is preferably carried out at the factory as part of the construction of the module. Assembly of one module to another is by bolting through the webs and plates.

A complete space frame built up from sixteen such modules is illustrated in FIG. 1, some of the modules being hidden from view by other parts of the structure to be described subsequently. The resulting structure is in the form of an upper grid 11 of upper structural members 15 (or 15I and 15T), a lower grid 12 of lower structural members 16 and vertical interconnecting structural members 14 extending between the upper and lower grids and joining the grids together to form a space frame. In practice a typical structure may be made up of a very much larger number of modules, possibly running to some hundreds of modules.

Edge modules correspond to the module 22 shown in FIG. 2 except that one upper and one lower member is left out and similarly, corner modules have only two upper and two lower members at right angles to each other.

The modular construction is particularly convenient for assembly of the structure on site, for example as a floor or roof. Some groups of modules may be assembled together at ground level or at another convenient site such as a previously constructed floor to form a sub-structure. The size of the sub-structure depends in part on the lifting capacity of an available crane. The sub-structure is then raised into position and mounted in its permanent position on a steel frame or similar basic building structure. Subsequent sub-structures are raised one at a time and joined either to the building framework or to adjacent sub-structures or both. A suitable pattern of working might be to start from one or more corners and work towards the centre. An alternative construction procedure would be to build up the structure one module at a time. The modular structure thus facilitates assembly of the space frame.

Figure 3:
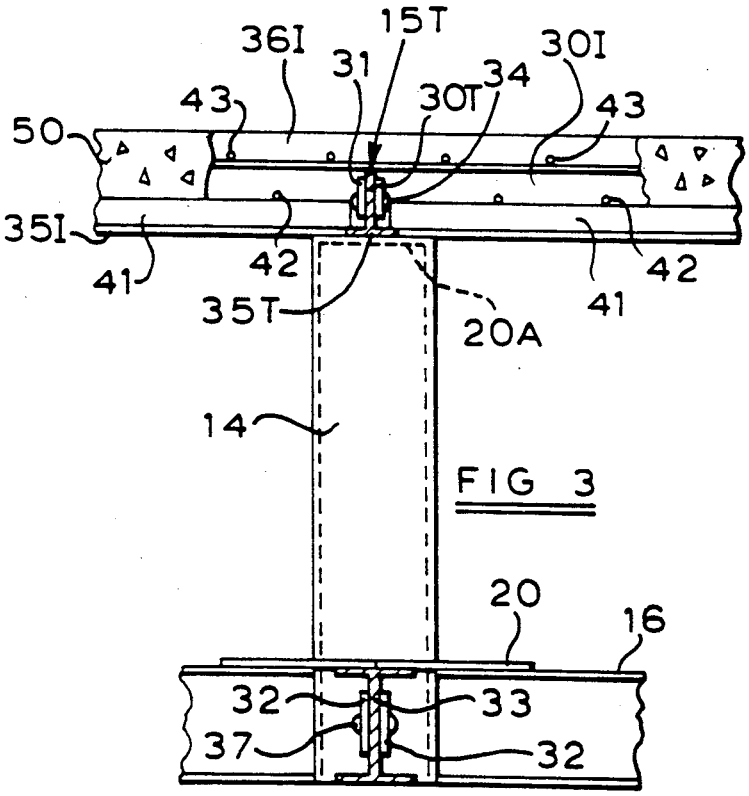
FIG. 3 is a cross section through a part of the structure.

The space frame made up of structural members is only a part of the complete space frame structure. As shown in FIGS. 1 and 3, permanent corrugated steel shuttering 41 is installed on the upper layer constituted by the structural members 15I and 15T. This shuttering is carried by the lower flanges 35I and 35T of the members 15I and 15T so that it lies within the depth of the upper structural members but the webs 30I and 30T of these members extend well above the shuttering and in particular the upper flanges 36I and the tops of webs 30I are positioned well above the shuttering.

FIG. 1 shows steel reinforcing rods 42, intended as concrete reinforcement, positioned on the shuttering across the corrugations. Rods 42 may be omitted in some installations. The reinforcement rods 42 are also well below the upper edge of the structural members 15. Further steel reinforcement 43 in the form of conventional welded mesh is positioned on the top surfaces of the structural members 15.

Concrete 50 is then poured on to the shuttering to such a depth that it extends above the top of the structural members 15 and also covers the upper layer 43 of reinforcement. In this way, members 15 become partially embedded in the concrete with the upper flanges of members 15I forming a key between the members and the concrete.

When the concrete has cured, the reinforced concrete adds to the strength of the upper structural members 15 of the space frame to provide an upper layer for the structure which is much stronger than the strength provided by members 15 alone. Clearly members 15I are more positively keyed to the concrete than are the members 15T, which are only keyed to the concrete at their intersections with members 15I. Therefore the concrete in the direction parallel to members 15I will contribute more to the strength of the composite structure than the concrete in the direction parallel to members 15T.

The structural members 15 are selected to give sufficient strength in the upper grid of the structure to provide a self-supporting steel space frame and to support the weight of shuttering, reinforcement, freshly poured concrete and other construction loads including the weight of operatives. In a typical case, this load requirement is about one quarter to one third of the strength required in use of the structure. The concrete after curing provides the additional strength. The embedding of the upper members 15 is particularly important because the concrete then supports these members against buckling, thereby increasing their contribution to the overall strength of the structure.

The top surface of the concrete may be used as a floor and the lower surface of the structure can be clad to provide a ceiling.

Figure 4:
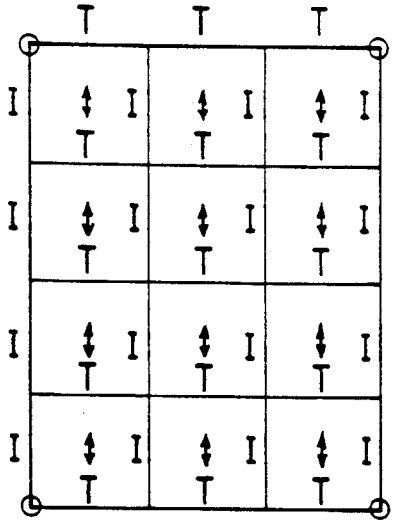
FIGS. 4 to 6 are diagrammatic illustrations of various forms of upper grid structure.
Figure 5:
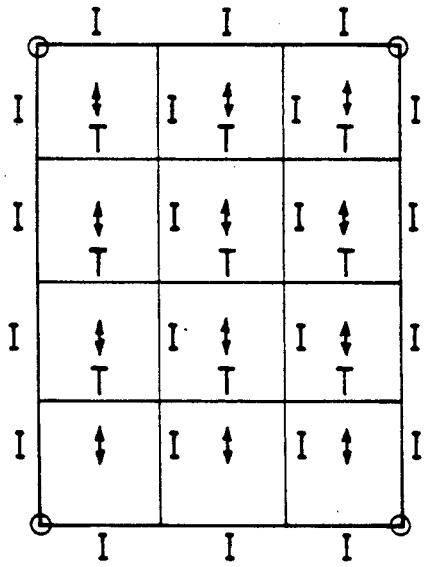
Figure 6:
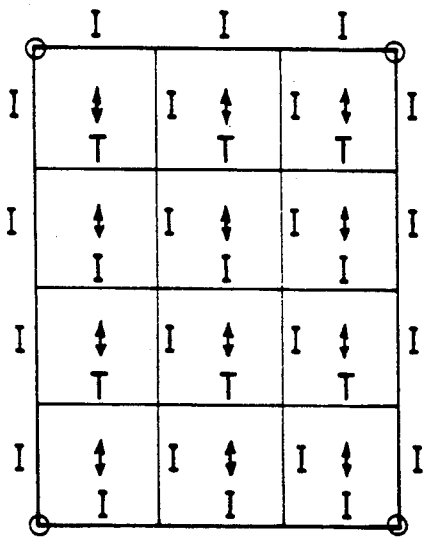

FIG. 4 illustrates diagrammatically the preferred arrangement of T-section and I-section members for an upper grid of structural members. In this example, all the members extending in one direction are of T-section and all of those extending in the direction perpendicular thereto are of I-section. Arrows indicate the longitudinal direction for the corrugations of the shuttering. FIG. 5 shows an alternative arrangement in which the T-sections around the edge of the structure or along spines joining adjacent columns which in turn support a larger floor structure are of I-section in both directions. This leaves some grid rectangles with only one T-section and thus with only one edge without a flange directed towards the rectangle. FIG. 6 shows a still further alternative in which I-sections are provided in one direction and I-sections and T-sections alternate in the direction at right angles thereto. This gives only one side of each rectangle without an inwardly directed flange for all of the rectangles. Other structures can be built up, for example by making use of inverted J-sections.

Typical procedures for insertion of shuttering will now be described with reference to FIG. 7 and 8.

Figure 7:
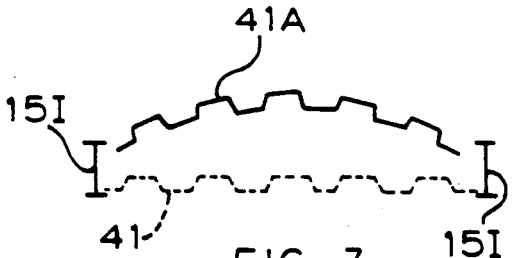
FIG. 7 illustrates the installation of corrugated steel shuttering.

FIG. 7 shows two parallel I-sections 15I and the final position of a corrugated shuttering panel is also shown at 41. With T-sections, and thus no upper flanges, at the ends of the rectangle represented by the two T-sections, it is a simple matter to bend the steel shuttering sheet as shown at 41A to provide clearance for its insertion under the top flanges of the I-sections. The decking then becomes supported by the bottom flanges of the I-sections and T-sections and flattens out automatically to the position shown at 41 to be fully supported. In the case with three I-sections and only a single T-section, the width of the decking is effectively reduced by bending for insertion under the end top flange but instead of a single simple curve as shown at 41A it may be necessary to adopt an S curve or otherwise to temporarily reduce the effective width to enable the shuttering to be inserted under the top flange at the end of the shuttering. The shuttering panel can then simply be dropped down as before with the absence of a flange at the opposite end allowing ready positioning.

Figure 8:
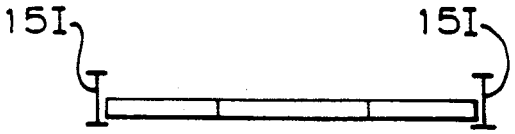
FIG. 8 illustrates the installation of shuttering in more than one piece.

In FIG. 8, the shuttering is made up of three longitudinally extending elements, for example pre-cast concrete panels. Because each of these has a width much less than that of the distance between the I-sections 15I, it is a simple matter even with only one end T-section (and one end I-section) to insert the individual panels under the end I-section and lower them one at a time into position.

Instead of upper members for each module constituted by a continuous I-section and two T-sections, the T-section may be continuous and have two separate I-sections welded in position. Similarly other forms of upright member besides the square section may be employed. For example the uprights could be I- section. Also the upper members do not need to be simple I and T-sections so long as they all have lower flanges and some do and some do not have upper flanges.

It is claimed:

1. A space frame structure comprising an upper rectangular grid of upper structural members; grid rectangles forming said grid each being defined by four upper structural members surrounding said grid rectangle; a lower grid of lower structural members spaced from the upper grid; interconnecting members extending between the upper grid and the lower grid and joining the grids together to form a space frame therewith; each such upper member having an upper edge and a lower edge defining a depth for said member and defining a web extending from said upper edge to said lower edge ; each such upper member having a lower flange at its lower edge; shuttering supported on said lower flanges; at least two of the upper members forming each of said grid rectangles each having an upper flange extending into the grid rectangle at the upper edges of said upper members; at least one of said upper members from said same grid rectangle being without an upper flange extending into said grid rectangle whereby said shuttering can be installed from above into said grid rectangle to an operative position where said shuttering is supported on said lower flanges; and a concrete layer supported on said shuttering and embedding the upper edges of the upper grid including said upper flanges.

2. A space frame structure according to claim 1 wherein for each of at least the majority of upper grid rectangles, two mutually opposed upper members of said shuttering members defining said grid rectangle have upper flanges extending into said grid rectangle and the remaining two mutually opposed upper members further defining said grid rectangle are without upper flanges extending into said grid rectangle.

3. A space frame structure according to claim 1 wherein the members of the upper grid extending in a first direction are primarily members each having an upper and a lower flange defining with said web an I-section extending in a first direction, and the members of the upper grid extending in a second direction, perpendicular to said first direction, each having a lower flange defining with said web an inverted T-section.

4. A space frame structure according to claim 1 wherein the members of the upper grid are I-section members extending in one direction and alternate inverted T-section and I-section members extending in the opposite direction whereby each grid rectangle has upper flanges extending into said grid rectangle along three sides thereof.

5. A space frame structure according to claim 1 wherein the shuttering is corrugated steel shuttering with corrugations extending longitudinally between upper members without upper flanges, said shuttering exhibiting lateral flexibility whereby said shuttering is deformed for insertion into said grid rectangle between said mutually opposed members having upper flanges, said shuttering is inserted under said upper flanges.

6. A space frame structure according to claim 1 wherein each grid rectangle has three members each with an upper flange extending into said grid rectangle and has one upper member without an upper flange, wherein the shuttering is corrugated steel shuttering with corrugations extending longitudinally between an upper member without a flange and an upper member with a flange, said shuttering exhibiting lateral flexibility whereby said shuttering is deformed for insertion into said grid rectangle between said upper members having a flange, said shuttering is inserted under said upper flanges.

7. A space frame structure according to claim 1 wherein the upper and lower grids and interconnecting members are constructed from a series of pre-fabricated modules each comprising an upright interconnecting member having a top and a bottom, upper horizontal structural members extending from the top thereof and lower horizontal structural members extending from the bottom thereof.

8. A structural module for use in a composite space frame structure according to claim 7 comprising an upright interconnecting member having a top and a bottom, four upper horizontal structural members extending at right angles to one another from the top thereof and lower structural members extending from the bottom thereof wherein at least two of the upper members each have a vertical web, an upper flange and a lower flange together defining an I-section and at least one of the upper members having a vertical web and a lower flange together defining an inverted T-section.

* * * * *